United States Patent [19]

Muellejans et al.

[11] 4,327,803

[45] May 4, 1982

[54] ARRANGEMENTS FOR CROSS-FLOW HEAT EXCHANGER UNITS

[75] Inventors: Herbert Muellejans, Stuttgart; Hans-Joachim Koetz, Nuertingen, both of Fed. Rep. of Germany

[73] Assignee: Süddeutsche Kühlerfabrik Julius Fr. Behr GmbH & Co., Stuttgart, Fed. Rep. of Germany

[21] Appl. No.: 32,826

[22] Filed: Apr. 24, 1979

[30] Foreign Application Priority Data

Apr. 25, 1978 [DE] Fed. Rep. of Germany ..... 2818041

[51] Int. Cl.[3] ..... F28F 3/00

[52] U.S. Cl. ..... 165/166

[58] Field of Search ..... 165/157, 166, 145, 151, 165/167

[56] References Cited

U.S. PATENT DOCUMENTS

| | | | |
|---|---|---|---|
| 1,409,520 | 3/1922 | Bird | 165/166 |
| 1,825,498 | 9/1931 | Wogan | 165/157 |
| 2,033,402 | 3/1936 | Smith | 165/166 |
| 3,666,007 | 5/1972 | Yoshino | 165/166 |
| 3,797,565 | 3/1974 | Fernandes | 165/111 |
| 3,986,549 | 10/1976 | Huggins | 165/157 |
| 3,986,549 | 10/1976 | Huggins | 165/82 |

FOREIGN PATENT DOCUMENTS

| | | | |
|---|---|---|---|
| 1075135 | 2/1960 | Fed. Rep. of Germany . | |
| 2542136 | 3/1977 | Fed. Rep. of Germany | 165/166 |
| 2615579 | 3/1977 | Fed. Rep. of Germany . | |
| 588672 | 6/1977 | Switzerland . | |

*Primary Examiner*—Samuel Scott
*Assistant Examiner*—Theophil W. Streule, Jr.
*Attorney, Agent, or Firm*—Schwartz, Jeffery, Schwaab, Mack, Blumenthal & Koch

[57] ABSTRACT

Arrangements for directing flow through one or more modular, cross-flow heat exchanger units having primary and secondary flow channels of respective predetermined lengths. The units are arranged in a housing having primary and secondary flow inlet and outlet openings such that a primary flow path and a secondary flow path are defined. The portion of each flow path over which intensive heat exchange occurs is no longer than the length of the associated flow channels. The units may be stacked along one or more axes normal to the planes of the flow channels.

4 Claims, 3 Drawing Figures

ARRANGEMENTS FOR CROSS-FLOW HEAT EXCHANGER UNITS

BACKGROUND OF THE INVENTION

1. Field of the Invention

The invention concerns an arrangement of cross-flow heat exchanger units, so-called modules, having ribbed surfaces, in a housing equipped with inlet and outlet openings for a primary stream and a secondary stream.

2. The Prior Art

Heat exchangers of the cross-flow type find applications, for example, in the process technology of the recovery of heat from exhaust gases. When it is desired to increase the capacity of such heat exchangers, it is possible, for example, to increase the heat exchange surface between the heat releasing and the heat absorbing media. However, this usually leads to an increase in the volume of the heat exchanger structure. In order to eliminate this disadvantage, the heat exchanger surfaces are provided with ribbing, which enhances the exchange of heat but also leads to an increase in the loss of pressure. DE-OS No. 26 15 579 disclosed an arrangement of heat exchanger units with corrugated ribs, wherein so-called core units are arranged spaced-apart at intervals. Flow through the units results in a series or in a partially-parallel manner.

This arrangement was chosen so that the individual heat exchanger units would be more accessible and thus easier to clean. The arrangement is not intended to improve performance; on the contrary, the connection in series of the individual heat exchanger units is detrimental to the thermal capacity of the entire installation. Thus, because of the intermixed arrangement of units with series and parallel flows, differing pressure losses and strongly-differing temperatures are obtained between the primary and the secondary flow. This constitutes one of the reasons why this known system cannot be arbitrarily enlarged to accommodate a higher level of heat exchange.

Swiss Patent CH-PS No. 588,672 also proposes an arrangement of cross-flow heat exchanger units, in which the units are arranged singly or in series-connected multiples in a housing, with bilateral flow through them. This arrangement has the aforedescribed disadvantage of poor thermal efficiency as the result of the diminishing mean temperature difference. Further, the system cannot be combined into large structural units, because an increase in losses of pressure would result.

SUMMARY OF THE INVENTION

It is the object of the invention to provide an arrangement of heat exchangers of modular design for the recovery of heat, preferably in the process and air-conditioning technologies, the arrangement having a small structural volume, relatively low weight and pressure loss appropriate to the operating conditions, while at the same time offering relatively high capacity and low production costs. It is a particular object of the invention to provide an arrangement of this type with extensive adaptability to various structural conditions and to the necessary capacity in relation to its dimensions.

The object is attained according to the invention in that the entire flow path of each of the primary and secondary flows from inlet opening to outlet opening is divided into a first flow path portion effectively capable of relatively intensive heat exchange and second flow path portions serving the purposes of inflow and outflow, and in that the length of the first path portion is no greater than a predetermined length "t" of channels in the modules. This principle of arranging heat exchanger units primarily results in the advantage that capacities of any desired magnitude may be accommodated without incurring excessive pressure losses, because the primary and secondary flows in any case will pass through no more than the depth of a single module. The loss of pressure experienced in the system is therefore determined by the pressure loss of an individual module. This design principle is particularly suitable for conditions prevailing in heat recovery situations (relatively low pressure and slight differences in temperature between the primary and the secondary flows.)

According to one advantageous embodiment of the invention, the modules are stacked adjacent one another to provide an increased heat exchange surface area. Because the modular units are charged in parallel, the net loss of pressure corresponds to the loss over the depth "t" of a single module.

According to a further embodiment, the modular units are arranged along axes adjacently to each other or above each other, or adjacently to and above each other, to form a honeycomb-like structure such that the primary and secondary flow channels of the units extend in co-parallel planes. In this arrangement, the modules are not positioned with their lateral surfaces facing one another, but instead with their lateral edges facing one another. Here again, the primary and the secondary flows pass only through the depth of one module.

According to a further advantageous feature, the modules have a square cross section and are installed in a housing having a larger cross section, the lateral surfaces of the modules being non-parallel to the lateral surfaces of the housing. This results in the formation of inflow and outflow channels for the primary and secondary flows between the lateral surfaces of the modules and of the housing. This arrangement likewise provides for the parallel feeding of flow through all of the modules, resulting in the aforementioned slight pressure loss of the system.

According to yet another advantageous feature, the modular units do not have their lateral edges in direct contact. Instead, spaces are provided for interconnecting the lateral edges of the units. The cross-sectional areas of the inflow and outflow channels are thus correspondingly enlarged.

According to still another feature, at least some of the inlet and outlet openings for the primary and secondary flows are provided in surfaces of the housing lying in planes parallel to the direction of flow through the modular units, while some of the inlet and outlet openings may be provided in housing surfaces lying perpendicular to the direction of flow through the modular units. This provides a number of possible variations for the direction of the inflow and the outflow. As in the above-mentioned arrangements, all of the modules are charged in parallel at the same pressure, while the directions of inflow and outflow are entirely or partially normal to the planes of flow through the modular units.

Preferred embodiments of the invention represented in the drawings are explained in more detail below.

THE PREFERRED EMBODIMENTS

Figure 1:
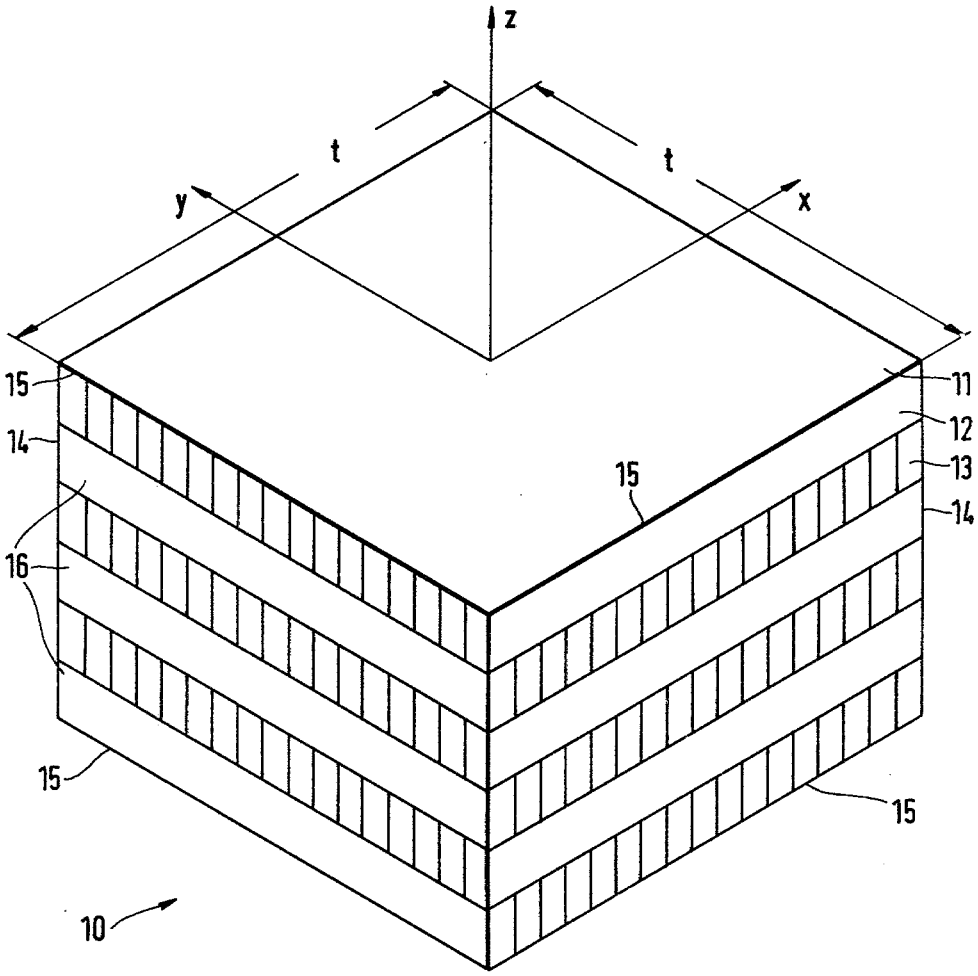
FIG. 1 shows a modular cross-flow heat exchanger unit.

FIG. 1 shows a modular heat exchanger unit 10, of a type generally known in the art, having primary and secondary streams flowing therethrough in mutually transverse directions in several co-parallel planes. Modular unit 10 comprises flow channels 12 and 13 extending in the x and y directions, respectively. The channels are separated by dividers 11, which run along or parallel to the x-y plane. Finally, the module 10 is bounded by lateral surfaces 16, which in turn have lateral edges 14 and front edges 15. The z axis is defined as the normal to the mutually co-parallel planes of dividers 11, and passes through these planes at the point where diagonals through a divider 11 would intersect.

Figure 2:
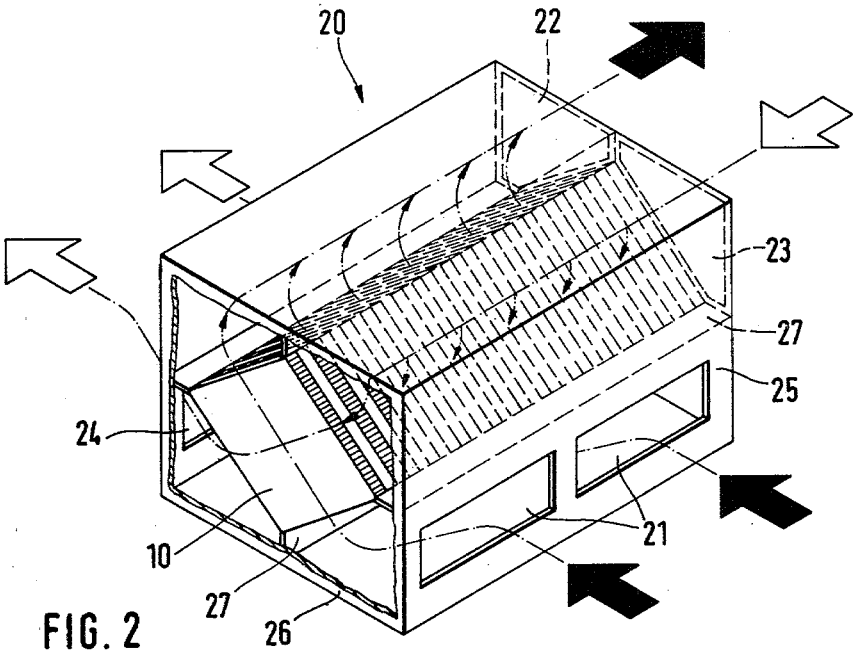
FIG. 2 shows a row of modular units positioned in a housing.

In FIG. 2, several modules 10 are stacked side-by-side along the z axis to form a row of modules. Spacers 27 connect lateral edges of the row of modular units 10 to interior surfaces of the housing. Modular units 10 preferably have a square cross section, as does the housing 20. The modular units are rotated by 45° with respect to the housing as shown. Together with spacers 27, the lateral surfaces of the modular units and the lateral surfaces of the housing yield flow channels for the inflow and the outflow. Inlet openings 21 for the primary flow are provided in lateral surface (or wall) 25 of the housing and outlet openings 22 for the primary flow are provided in front surface (or wall) 26 of the housing. Similarly, front housing surface 26 has an inlet opening 23 for the secondary flow and the lateral housing surface 25 has outlet openings 24. It is possible to arbitrarily vary this arrangement of inlet and outlet openings, but the fact that the flow passes through each modular unit only once in the direction of its depth "t" is assured in all of the possible variants. As can be seen, the depth "t" of each modular unit 10 represents the length of the respective primary and secondary flow channels.

Figure 3:
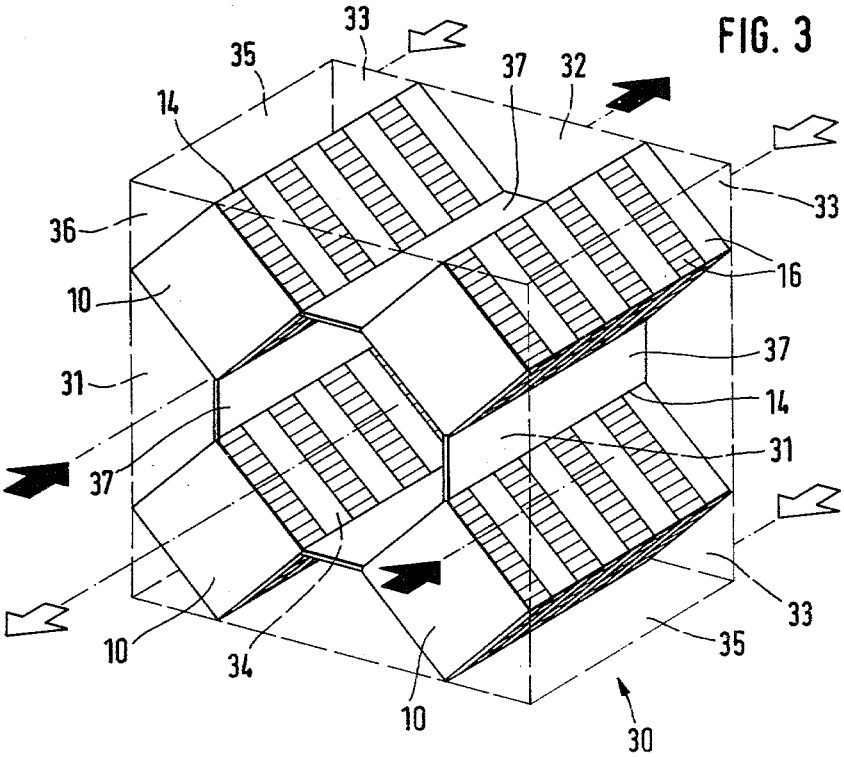
FIG. 3 shows several rows of modular units arranged in a honeycomb pattern within a housing.

In FIG. 3, several rows of modules 10 (each row similar to the arrangement of FIG. 2) are arranged in a honeycomb-like design in a housing 30. Spacers 37 interconnect lateral edges of the rows of modules so that channels for the inflow and outflow of the primary and the secondary flows are obtained. The portions of the flow channels other than the passageways through the units themselves are referred to as the remaining portions, and these remaining portions are composed of various segments, as will be apparent from FIG. 3. With such an arrangement, sets of flow passageways of the individual modular units 10 receive flow entering the housing in the z direction, by means of a central channel defined by lateral surfaces of the modular units and by the four spacers 37. The incoming flow 15 is thereafter deflected in a direction parallel to the divider planes of the individual modular units and subsequently again deflected for outflow from the housing, following its exit from modules 10. For this purpose, the inlet openings or ports 31 and outlet openings or ports 32 for the primary flow and the inlet openings or ports 33 and outlet openings or ports 34 for the secondary flow, are all provided in the two front surfaces (or walls) 36 of the housing which lie in parallel with divider planes 11. The rows of modules 10 are interconnected by means of the spacers 37 at their lateral edges 14, to form the central openings or flow channel. The honeycomb-like arrangement shown in FIG. 3, consisting of four rows of modules, may be supplemented or multiplied as required in the upward direction or in the lateral direction, or in the upward and lateral directions, thus providing larger structural units. All such arrangements have in common the fact that the pressure loss through the entire structure corresponds to that occurring over the flow depth "t" of a single modular unit 10.

We claim:

1. A cross-flow heat exchanger arrangement comprising:

a housing;

primary and secondary flow channels passing through said housing, each said flow channel having ends; said primary flow channel having a primary flow port at each end, said secondary flow channel having a secondary flow port at each end;

a plurality of heat exchanger units in said housing, each heat exchanger unit including a set of primary flow passageways extending in one direction and a set of secondary flow passageways extending in another direction, said sets of first and second flow pasageways each being portions of said first and second flow channels, respectively, said first and second flow passageways providing a relatively intensive exchange of heat, said primary and secondary flow channels having remaining portions serving for inflow and outflow;

said remaining portions of said primary flow channel including first, second and third primary segments, said first primary segment extending between one primary port of said primary flow channel and said primary flow passageways of one heat exchanger unit to establish communication therebetween, said second primary segment extending between said one primary port of said primary flow channel and said set of primary flow passageways of another heat exchanger unit to establish communication therebetween, said third primary segment extending between the other primary port of said primary flow channel, on the one hand, and said sets of primary passageways of both said one and said other heat exchanger units, on the other hand, to establish communication therebetween, so that said set of primary flow passageways of said one heat exchanger unit is fluidly coupled in parallel with said set of primary flow passageways of said other heat exchanger unit and so that a fluid flow path is established which is divided between one primary branch including said one heat exchanger unit and another primary branch including said other heat exchanger unit in which fluid flowing between said one primary port and said other primary port through said one primary branch passes only through said one heat exchanger unit and in which fluid flowing between said one primary port and said other primary port through said other primary branch passes only through said other heat exchanger unit;

said remaining portions of said secondary flow channel including first, second and third secondary segments, said first secondary segment extending between one secondary port of said secondary flow channel and said set of secondary flow passageways of said one heat exchanger unit to establish communication therebetween, said second secondary segment extending between said one secondary port of said secondary flow channel and said set of secondary flow passageways of said other heat exchanger unit to establish communication therebetween, said third secondary segment extending between the other secondary port of said secondary flow channel, on the one hand, and said sets of secondary passageways of both said one and said other heat exchanger units, on the other hand, to establish communication therebetween, so that said set of secondary flow passageways of said one heat exchanger unit is fluidly coupled in parallel with said set of secondary passageways of said other heat exchanger unit and so that a fluid flow path is established which is divided between one secondary branch including said one heat exchanger unit and another secondary branch including said other heat exchanger unit in which fluid flowing between said one secondary port and said other secondary port through said one branch passes only through said one heat exchanger unit and in which fluid flowing between said one secondary port and said other secondary port through said other secondary branch passes only through said other heat exchanger unit.

2. A cross-flow heat exchanger arrangement as defined in claim 1, wherein:

said one primary port comprises a pair of openings, one of said openings communicating with said first primary segment, the other of said openings communicating with said second primary segment;

said one secondary port comprises a pair of secondary openings, one of said secondary openings communicating with said first secondary segment, the other of said secondary openings communicating with said second secondary segment.

3. A cross-flow heat exchanger arrangement as defined in claim 2, wherein:

said one and said other primary openings are inlet openings and said other port is an outlet;

said one and said other secondary openings are inlet openings and said other secondary port is an outlet.

4. A cross-flow heat exchanger unit as defined in claim 3, including first, second, third and fourth heat exchanger units, said heat exchanger units having axes which are perpendicular to their first and second sets of passageways, said heat exchanger units being arranged so as to surround a central space and so that their axes are all parallel to each other, the axes being disposed in a pair of parallel planes, said one heat exchanger unit including said first and second heat exchanger units, said other heat exchanger unit including said third and fourth heat exchanger units;

said first primary segment of said primary flow channel being defined between said first and second heat exchanger units, said second primary segment being defined between said third and fourth heat exchanger units and said third primary segment having two parts, one being defined between the first and third heat exchanger units and the other being defined between the second and fourth heat exchanger units;

wherein said first secondary segment of said secondary flow channel includes two parts, one part being adjacent the first heat exchanger unit, the other part being adjacent the second heat exchanger unit, said second secondary segment also including two parts, one of which is adjacent the third heat exchanger unit, the other of which is adjacent the fourth heat exchanger unit; and wherein said third secondary segment is defined by said central space which the four heat exchanger units surround.

* * * * *